US005758895A

United States Patent [19]

Bumgarner

[11] Patent Number: 5,758,895

[45] Date of Patent: Jun. 2, 1998

[54] SNOWBOARD BINDING STRAPS AND LOCKING BAR ASSEMBLY

[76] Inventor: Scott Edward Bumgarner, 4426 Tulane Ave., Long Beach, Calif. 90808

[21] Appl. No.: 729,644

[22] Filed: Oct. 21, 1996

[51] Int. Cl.[6] ..... A63C 9/14

[52] U.S. Cl. ..... 280/607; 280/623; 280/14.2

[58] Field of Search ..... 280/607, 611, 280/617, 618, 623, 633, 635, 636, 14.2; 441/70

[56] References Cited

U.S. PATENT DOCUMENTS

| | | | |
|---|---|---|---|
| 31,280 | 1/1861 | Gibbs . | |
| D. 308,997 | 7/1990 | Katz . | |
| 3,662,435 | 5/1972 | Allsop . | |
| 4,157,191 | 6/1979 | Ramer . | |
| 5,028,068 | 7/1991 | Donovan . | |
| 5,143,396 | 9/1992 | Shaanan et al. | 280/14.2 |
| 5,172,914 | 12/1992 | Barci . | |

*Primary Examiner*—Richard M. Camby
*Attorney, Agent, or Firm*—Price, Gess & Ubell

[57] ABSTRACT

A snowboard binding straps and locking bar assembly is disclosed which can be used with a variety of snowboard baseplates. Two adjustable straps attach to one side of a baseplate. The opposite ends of the adjustable straps attach to a locking bar. A pivot connector is attached to a front side of the baseplate and a locking means attaches to a back side of the baseplate, behind the pivot connector. The locking bar has a curved front end to lockingly engage the pivot connector, and a tongue having a latching notch is attached to the back end of the locking bar. In operation, the locking bar is lockingly engaged with the pivot connector and the latching notch of the tongue is inserted into the locking means until the tongue is locked into place. A handle on the locking bar is lifted to release the assembly, providing a quick step-in and release snowboard binding which can be used to retrofit existing snowboard baseplates.

12 Claims, 2 Drawing Sheets

SNOWBOARD BINDING STRAPS AND LOCKING BAR ASSEMBLY

BACKGROUND OF THE INVENTION

1. Field of the Invention

The present invention relates generally to the field of snowboard bindings and, more particularly, to a retrofittable snowboard binding straps and locking bar assembly.

2. Description of Related Art

Snowboarding is a popular winter sport combining the features of skateboarding or surfing with snow skiing. Specifically, snowboards are generally short, wide boards in which the rider places both feet on the snowboard. In order to facilitate control of the snowboard, the rider's feet are usually positioned sideways to the length of the snowboard. Snowboards use bindings to attach a rider's feet to the snowboard, with one binding for each foot. The bindings are generally rigidly fixed to the snowboard, and provide some mechanism for securing a rider's boots to the board. Ideally, a binding should hold a rider's boot firmly, but comfortably, and be easy to fasten and unfasten. Numerous bindings have been disclosed in the prior art, but all have various shortcomings.

U.S. Design Pat. No. 308,997 discloses a binding for a snowboard having adjustable straps for securing a rider's boot. However, the disclosed binding lacks a quick step-in and release feature wherein a rider can easily and quickly secure and release the bindings. Thus, a rider must manually fasten and unfasten the strap buckles on each use of the snowboard. It would be desirable to able to adjust and set the straps once, and thereafter use a quick step-in and release mechanism to secure the rider's foot.

One example of a quick step-in and release mechanism for securing a skater's foot to a skate is disclosed in U.S. Pat. No. 31,280. According to this patent, a skater's shoe is secured to a skate by means of a pair of levers which pivot from the front part of the skate and attach at the rear of the skate to a ratchet locking engagement. Attached to the levers are broad bands of leather or other material to secure the user's shoe to the skate. This structure has several limitations for snowboard use, however. First the lever and ratchet locking mechanism do not provide the necessary secure locking required for snowboarding. Also, the fastening arrangement lacks sufficient adjustability to comfortably secure any snowboarder's boots which vary in size and construction. Finally, the structure is not suitable for use with snowboard straps which can be adapted to use with many different types of baseplates.

An improvement in snowboard bindings, having a quick step-in and release feature, is disclosed in U.S. Pat. No. 5,143,396. This patent discloses a boot support structure for supporting a rider's foot and an associated locking bar and straps for securing the rider's foot in the boot support structure. Specifically, two straps are each attached to one side of the boot structure. The opposite ends of the straps are secured to a locking bar. The locking bar has a pivoting type connection on the front and a locking mechanism for securing the bar to the boot support structure on the back. The locking bar and straps provide a convenient means for allowing quick step-in and release of a rider's foot. However, the locking bar and straps disclosed are specifically designed to function in cooperation with the disclosed boot support structure and lacks a convenient release latch. It would be desirable to have a locking bar and strap assembly which could be used with a variety of different support baseplates, such as regular, goofy, front or back foot, and base or baseless and which could be released quickly and easily. It would also be desirable to have a locking bar and strap assembly which can retrofit existing boot support baseplates, requiring only a minimal amount of modification.

OBJECTS AND SUMMARY OF THE INVENTION

The present invention is a binding strap and locking bar assembly suitable for use with a variety of different types of baseplates, a baseplate generally having a first and second sides, and a front and a back. An adjustable strap having a first and second end has the first end attached to the back of a first side of a baseplate. The second end of the strap is connected to a tongue having a latching notch perpendicular to the width of the tongue. A pivot connector is fastened to the front of a second side of the baseplate. A locking means is fastened to the back of the second side of the baseplate. A locking bar having a front and back end has a front end pivot connector engaging means for lockingly engaging the pivot connector, and the back end attaches to the adjustable strap and to the tongue at a point above the latching notch. The locking bar lockingly engages the pivot connector and the latching notch of the tongue is inserted into the locking means securing the rider's ankle into the baseplate. To release the foot, the locking means is released, in turn releasing the tongue. One or more additional straps may be attached to the first side of the baseplate and to the locking bar to secure the foot to the baseplate. Specifically, an additional adjustable strap may be attached to the front of the first side and to the front end of the locking bar, just behind the pivot engaging means. The first adjustable strap and the tongue may comprise a unitary strap, instead of two separate pieces.

BRIEF DESCRIPTION OF THE DRAWINGS

The exact nature of this invention, as well as its objects and advantages, will become readily apparent from consideration of the following specification as illustrated in the accompanying drawings, in which like reference numerals designate like parts throughout the figures thereof, and wherein.

DESCRIPTION OF THE PREFERRED EMBODIMENTS

The following description is provided to enable any person skilled in the art to make and use the invention and sets forth the best modes contemplated by the inventor for carrying out the invention. Various modifications, however, will remain readily apparent to those skilled in the art, since the basic principles of the present invention have been defined herein specifically to provide a retrofittable snowboard binding straps and locking bar assembly.

Figure 1:
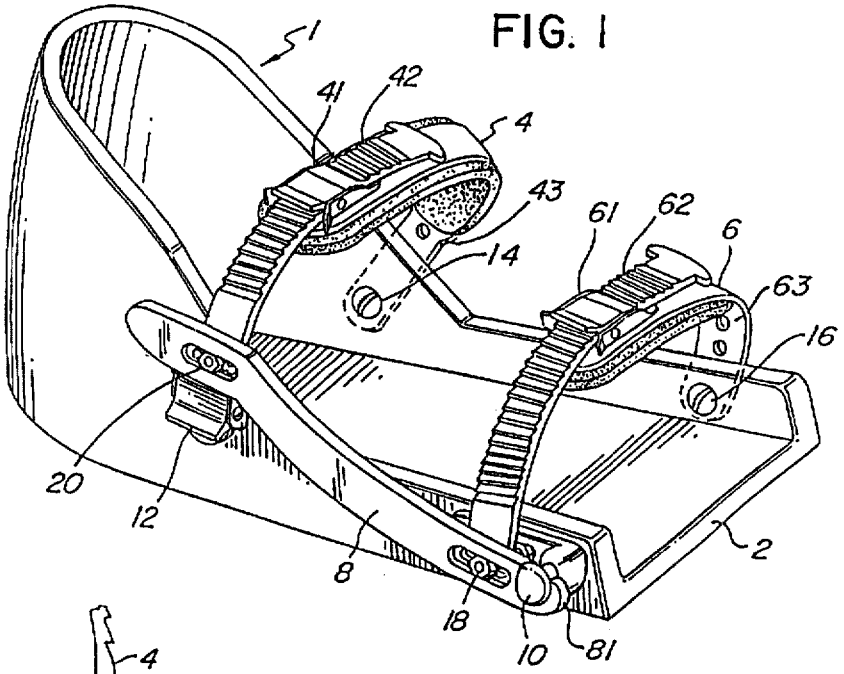
FIG. 1 is a perspective view of the locking bar and strap assembly of the present invention as attached to a baseplate.

Referring to FIG. 1, a snowboard binding 1 has a baseplate 2. The present invention is designed to work with a variety a different baseplate styles and types, and the baseplate shown is merely for purposes of description, and not limitation. An adjustable strap 4 is attached to a back first side of baseplate 2 by a fastener 14. The fasteners in this embodiment are shown as bolts, having associated hardware such as nuts, but any suitable fastening means may be employed. In the presently preferred embodiment, a second adjustable strap 6 is attached to a front first side of baseplate 2 by a fastener 16. The adjustable straps 4, 6 may be of any suitable strap material, and preferably employ slidable locking mechanisms 41, 61 which engage groves 42, 62 notched in the strap material for easy adjustment. The adjustable straps 4, 6 may further include several attachment holes 43, 63 for attaching the straps 4, 6 to the baseplate 2 with the fasteners 14, 16. The attachment holes 43, 63 provide for course length adjustment of the straps 4, 6.

Figure 6:
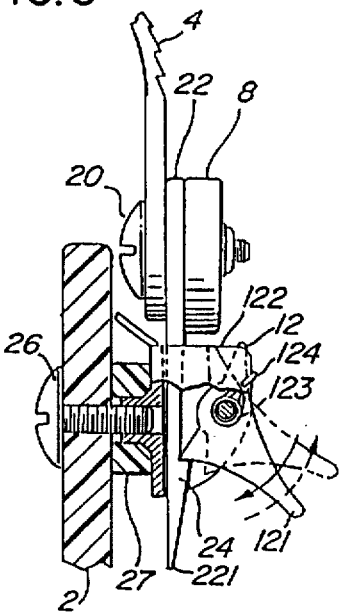
FIG. 6 shows the same view as FIGS. 4 and 5, with the locking bar and strap assembly completely inserted into the side locking means.
Figure 7:
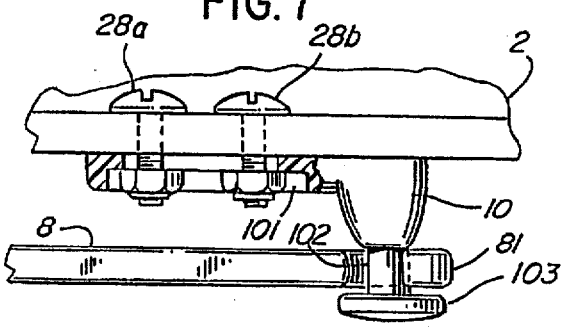
FIG. 7 is a top view showing the locking bar engaging the pivot connector.

A locking bar 8 is attached to the adjustable straps 4, 6 with fasteners 18, 20. A pivot connecter 10 is mounted on a front second side of the baseplate 2, as shown in FIG. 7, by fasteners 28*a*, 28*b*. The pivot connector 10 comprises a mounting bracket 101, fastening rod 102 and end-cap 103. The pivot connector 10 is a unitary piece, wherein the fastening rod 102 lockingly engages the locking bar 8, and the end-cap 103 prevents the locking bar 8 from sliding off the fastening rod 102. In the presently preferred embodiment, a front end 81 of the locking bar 8 is curved to lockingly engage the fastening rod 102 of the pivot connector 10. However, any similar arrangement may be used. For example, the locking bar 8 may have a hole which engages a hook in place of the pivot connector 10. A locking means 12 is attached to the back of the baseplate 2, the attachment and operation of the locking means 12 is described in detail below, with reference to FIGS. 4–6. As illustrated in FIG. 1, the alignment of the straps 4, 6 is such that the straps 4, 6 should cross the baseplate 2 perpendicular to the length of the baseplate 2.

Figure 4:
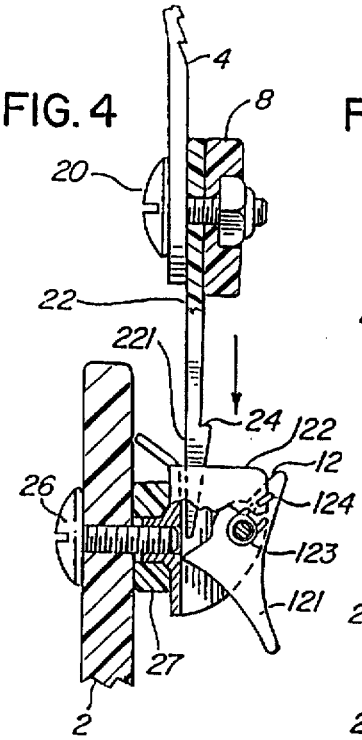
FIG. 4 is a cross-sectional detailed view of the locking bar and strap assembly being inserted into the side locking means.

Referring to FIG. 4, a tongue 22 is attached to the locking bar 8 and the adjustable strap 4 by fastener 20. In this preferred embodiment, the tongue 22 is shown as a separate member, but could be incorporated into a unitary strap member, with the adjustable strap 4. The tongue 22 is preferably a separate member so that it can be made of a stiffer material than the adjustable strap 4, thereby providing a tongue 22 which is tapered on one end 221 and has a latching notch 24, for engaging the locking means.

Figure 2:
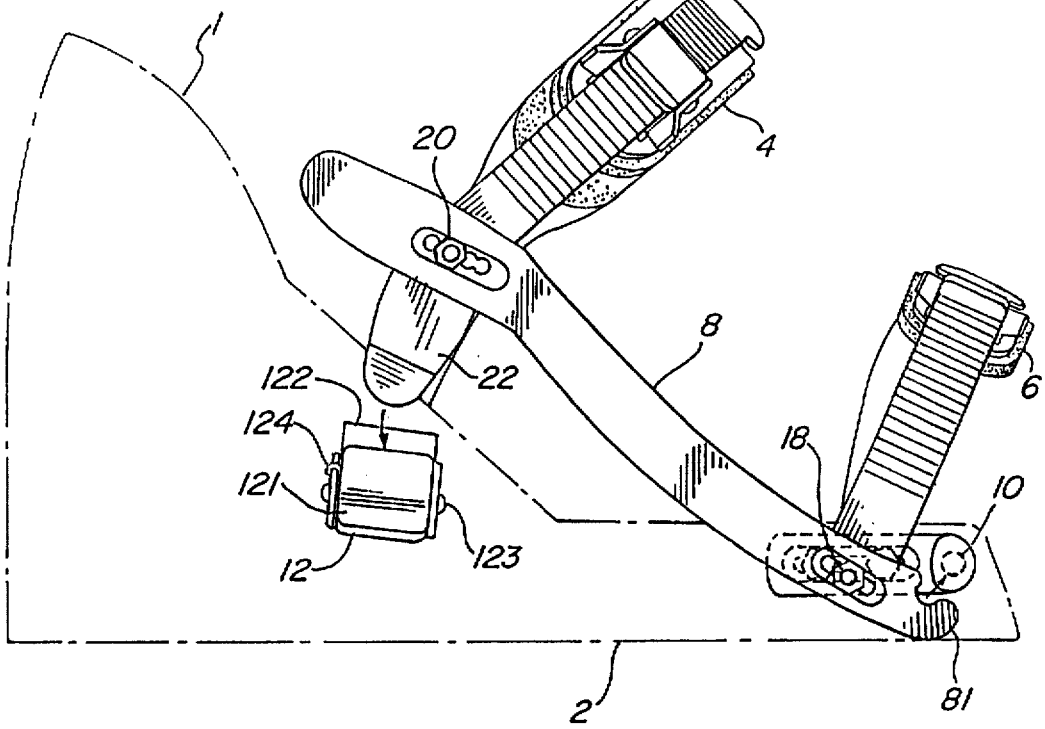
FIG. 2 is a side view illustrating the locking bar and strap assembly hooking on the pivot connector and locking into the side locking means.
Figure 3:
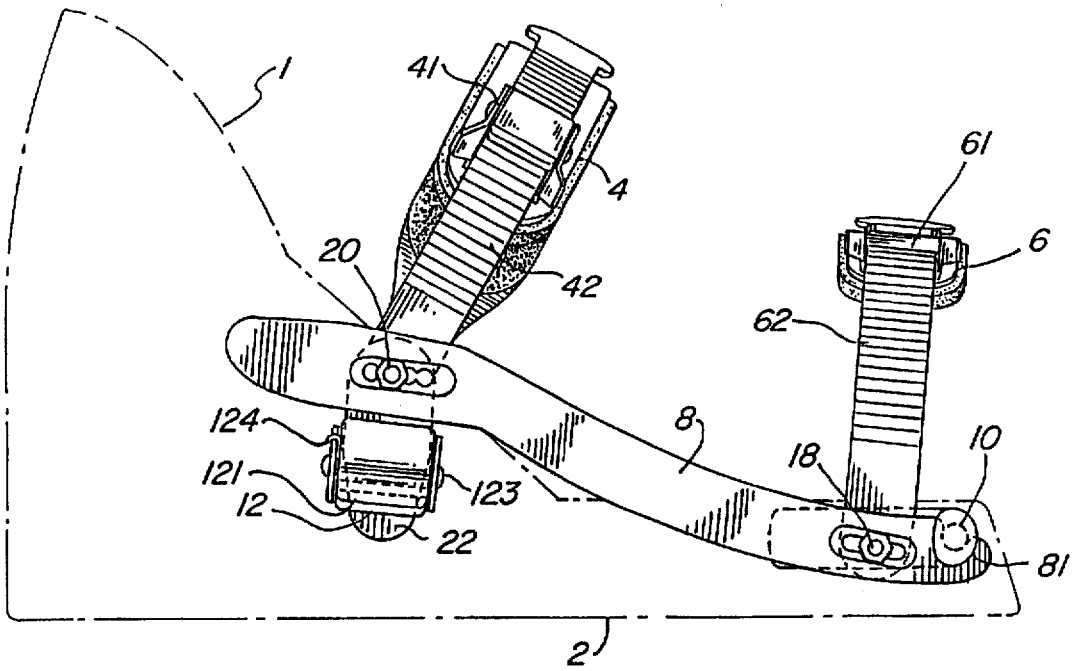
FIG. 3 is a side view illustrating the locking bar of FIG. 2 after the locking bar is locked into position.

FIGS. 2 and 3 illustrate the operation of the present invention. In FIG. 2, the front end 81 of the locking bar 8 is inserted under the pivot connector 10. Once the front end 81 is hooked under the pivot connector 10, as illustrated in FIG. 7, the tongue 22 is inserted into the locking means until the tongue 22 is locked into place. FIG. 3 shows the present invention in the fully locked position. To release the straps 4, 6 from the rider's foot, the handle 121 is lifted up to release the tongue 22, and the locking bar 8 is removed from the pivot connector 8.

Figure 5:
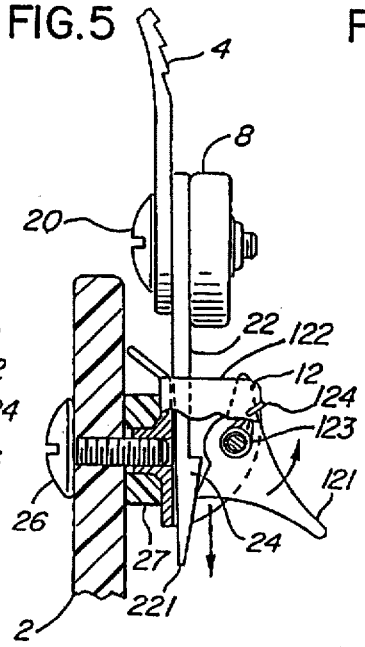
FIG. 5 shows the same view as FIG. 4, with the locking bar and strap assembly partially inserted into the side locking means.

The operation of the locking means will now be described with reference to FIGS. 4–6. The locking means 12 is attached to the baseplate 2 by a fastener 26 and a spacer-nut 27. The locking means 12 has a base unit 122 which is connected to a handle 121 via a pivot pin 123. The handle is under spring tension from spring 124, causing the handle to spring down into a locked position. As the tapered end 221 of tongue 22 is inserted into the locking means 12, the handle 121 is forced open, as shown in FIG. 5. Once the latching notch 24 is inserted past the handle 121, the spring 124 forces the handle back down and locks the tongue 22 into place. To release the tongue 22, the handle 121 is lifted, releasing the latching notch 24.

Modifications to the above-described embodiments include combining the two adjustable straps 4, 6 into a single wide strap or combining the first strap 4 and the tongue 22 into a unitary strap piece. Also the front end 81 of the locking bar 8 could permanently attach to the pivot connector 10 wherein the pivot connector comprises a swivel connector which allows the locking bar 8 to swing out sideways or up from the baseplate to allow for the insertion and removal of the rider's foot.

The binding straps and locking bar assembly of the present invention is uniquely suited to be used with a variety of snowboard baseplates. The design allows existing baseplates to be easily retrofitted. Furthermore, the design allows for quick step-in and release of the straps, without requiring further adjustment once the straps are set.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A snowboard binding strap assembly suitable for operation with a variety of snowboard binding baseplates, a baseplate having a front and a back, and a first side and a second side, the assembly comprising:

an adjustable strap having a first end and a second end, the first end having a latching notch perpendicular to the strap;

a first fastening means for fastening the second end of the adjustable strap to a back second side of a baseplate;

a pivot connector;

a second fastening means for fastening the pivot connector to a front first side of the baseplate;

a locking bar having a front end and a back end, the front end of the locking bar having a pivot connector engagement means for lockingly engaging the pivot connector;

a third fastening means for fastening the first end of the adjustable strap, at a point above the latching notch, to the back end of the locking bar;

a locking means for lockingly engaging the latching notch on the first end of the adjustable strap; and a fourth fastening means for fastening the locking means to a back first side of the baseplate.

2. The snowboard binding strap assembly of claim 1, further comprising a second adjustable strap attached to a front second side and to the front end of the locking bar, behind the pivot connector engagement means.

3. The snowboard binding strap assembly of claim 2, wherein the pivot connector is a unitary member comprising a mounting bracket, fastening rod and end-cap, the end-cap on one end of the fastening rod, and the fastening rod extending out of the mounting bracket.

4. A snowboard binding strap assembly of claim 3, wherein the locking means comprises:

a base unit mounted to the baseplate by the fourth fastening means;

a handle;

a pivot pin connecting the base unit and the handle; and a tensioning spring positioned on the pivot pin, the spring keeping the handle in a down position against the base unit.

5. The snowboard binding strap assembly of claim 4, wherein the adjustable strap does not have the latching notch and the strap terminates at the locking bar, and the assembly further comprises:

a tongue having a latching notch perpendicular to a length of the tongue, the tongue fastened to the locking bar and the adjustable strap by the third fastening means, and wherein the latching notch on the tongue lockingly engages the locking means.

6. The snowboard binding strap assembly of claim 5, wherein the pivot engagement means comprises an upwardly curving hook for hooking under the fastening rod of the pivot connector.

7. A snowboard binding strap assembly suitable for operation with a variety of snowboard binding baseplates, a baseplate having a front and a back, and a first side and a second side, the assembly comprising:

a first adjustable strap having a first end and a second end;

a second adjustable strap having a first end and a second end;

a first fastening means for fastening the second end of the first adjustable strap to a back second side of a baseplate;

a second fastening means for fastening the second end of the second adjustable strap to a front second side of the baseplate;

a pivot connector;

a third fastening means for fastening the pivot connector to a front first side of the baseplate;

a locking bar having a front end and a back end, the front end of the locking bar having a pivot connector engagement means for lockingly engaging the pivot connector;

a tongue having a first end and a second end, the second end comprising a latching notch perpendicular to the length of the tongue;

a fourth fastening means for fastening the first end of the adjustable strap to the back end of the locking bar and to the first end of the tongue;

a locking means for lockingly engaging the latching notch on the second end of the tongue; and a fifth fastening means for fastening the locking means to a back first side of the baseplate.

8. The snowboard binding strap assembly of claim 7, wherein the pivot connector is a unitary member comprising a mounting bracket, fastening rod and end-cap, the end-cap on one end of the fastening rod, and the fastening rod extending out of the mounting bracket.

9. The snowboard binding strap assembly of claim 8, wherein the locking means comprises:

a base unit mounted to the baseplate by the fourth fastening means;

a handle;

a pivot pin connecting the base unit and the handle; and a tensioning spring positioned on the pivot pin, the spring holding the handle in a down position against the base unit.

10. The snowboard binding strap assembly of claim 9, wherein the pivot engagement means comprises an upwardly curving hook for hooking under the fastening rod of the pivot connector.

11. A snowboard binding strap assembly suitable for operation with a variety of snowboard binding baseplates, a baseplate having a front and a back, and a first side and a second side, the assembly comprising:

a first adjustable strap having a first end and a second end;

a second adjustable strap having a first end and a second end;

a first fastening means for fastening the second end of the first adjustable strap to a back second side of a baseplate;

a second fastening means for fastening the second end of the second adjustable strap to a front second side of the baseplate;

a pivot connector, the pivot connector being a unitary member and comprising:

a mounting bracket;

a fastening rod; and an end-cap, wherein the end-cap is on one end of the fastening rod, and the fastening rod extends out of the mounting bracket;

a third fastening means for fastening the pivot connector to a front first side of the baseplate;

a locking bar having a front end and a back end, the front end of the locking bar having an upwardly curving hook for hooking under the fastening rod of the pivot connector and for lockingly engaging the pivot connector;

a tongue having a first end and a second end, the second end comprising a latching notch perpendicular to the length of the tongue;

a fourth fastening means for fastening the first end of the adjustable strap to the back end of the locking bar and to the first end of the tongue;

a locking means for lockingly engaging the latching notch on the second end of the tongue, the locking means comprising:

a base unit;

a handle;

a pivot pin connecting the base unit and the handle; and a tensioning spring positioned on the pivot pin, the spring holding the handle in a down position against the base unit; and a fifth fastening means for fastening the base unit of the locking means to a back first side of the baseplate.

12. The snowboard binding strap assembly of claim 9, wherein the pivot engagement means comprises an upwardly curving hook for hooking under the fastening rod of the pivot connector.

* * * * *